US009420835B2

(12) United States Patent
Jorge

(10) Patent No.: US 9,420,835 B2
(45) Date of Patent: Aug. 23, 2016

(54) MOUTH MESH

(71) Applicant: David Jorge, Morristown, NJ (US)

(72) Inventor: David Jorge, Morristown, NJ (US)

( * ) Notice: Subject to any disclaimer, the term of this patent is extended or adjusted under 35 U.S.C. 154(b) by 0 days.

(21) Appl. No.: 14/544,186

(22) Filed: Dec. 8, 2014

(65) Prior Publication Data

US 2016/0157534 A1 Jun. 9, 2016

(51) Int. Cl.
*A61B 19/00* (2006.01)
*A41D 13/11* (2006.01)

(52) U.S. Cl.
CPC ..... *A41D 13/1169* (2013.01)

(58) Field of Classification Search
CPC ..... A41D 13/1169
USPC ..... 128/863, 206.14
See application file for complete search history.

(56) References Cited

U.S. PATENT DOCUMENTS 2,566,557 A * 9/1951 Danielson ..... A61F 5/08 128/863
2,928,388 A * 3/1960 Jaroslaw ..... A41D 13/1176 128/206.14
5,797,146 A * 8/1998 Matich ..... A42B 1/046 128/206.14
7,077,140 B1 * 7/2006 Berke ..... A41D 13/1176 128/200.18
2011/0197898 A1 * 8/2011 Chiu ..... A41D 13/1184 128/859
2012/0192876 A1 * 8/2012 Fujimori ..... A62D 9/00 128/863
2013/0291876 A1 * 11/2013 Angadjivand ..... A62B 23/025 128/863

* cited by examiner

*Primary Examiner* — Kristen Matter

(57) ABSTRACT

The Mouth Mesh invention is a round device that fits around a person's mouth area just under the nose and has an outer screen mesh with an inside nylon screen mesh with a tighter cell area to stop any spittle from a person's mouth to spray and spread into the air around other people. It allows the person wearing it to talk freely while it is adhered to the mouth area without falling off of the person's mouth area.

1 Claim, 3 Drawing Sheets

MOUTH MESH

BACKGROUND OF THE INVENTION (1) Field of the Invention

The present disclosure generally pertains to the field of oral devices to prevent bacteria from being spread.

(2) Description of the Related Art

No opposing patent was found.

BRIEF SUMMARY OF THE INVENTION

The Mouth Mesh is a unique protective device that fits around a person's mouth and prevents spittle from spewing into the air therefore protecting others from bacteria being spread. Saliva may leave an individual's mouth when they are talking, coughing or sneezing and the Mouth Mesh will stop any of the spittle from spraying into the air.

BRIEF DESCRIPTION OF THE SEVERAL VIEWS OF THE DRAWINGS

There are 3 drawings in total that describe and illustrate the design and function of the Mouth Mesh. The broken lines showing an environment is for the illustrative purpose and forms no part of the claimed application.

DETAILED DESCRIPTION OF THE PREFERRED EMBODIMENT

Figure 1:
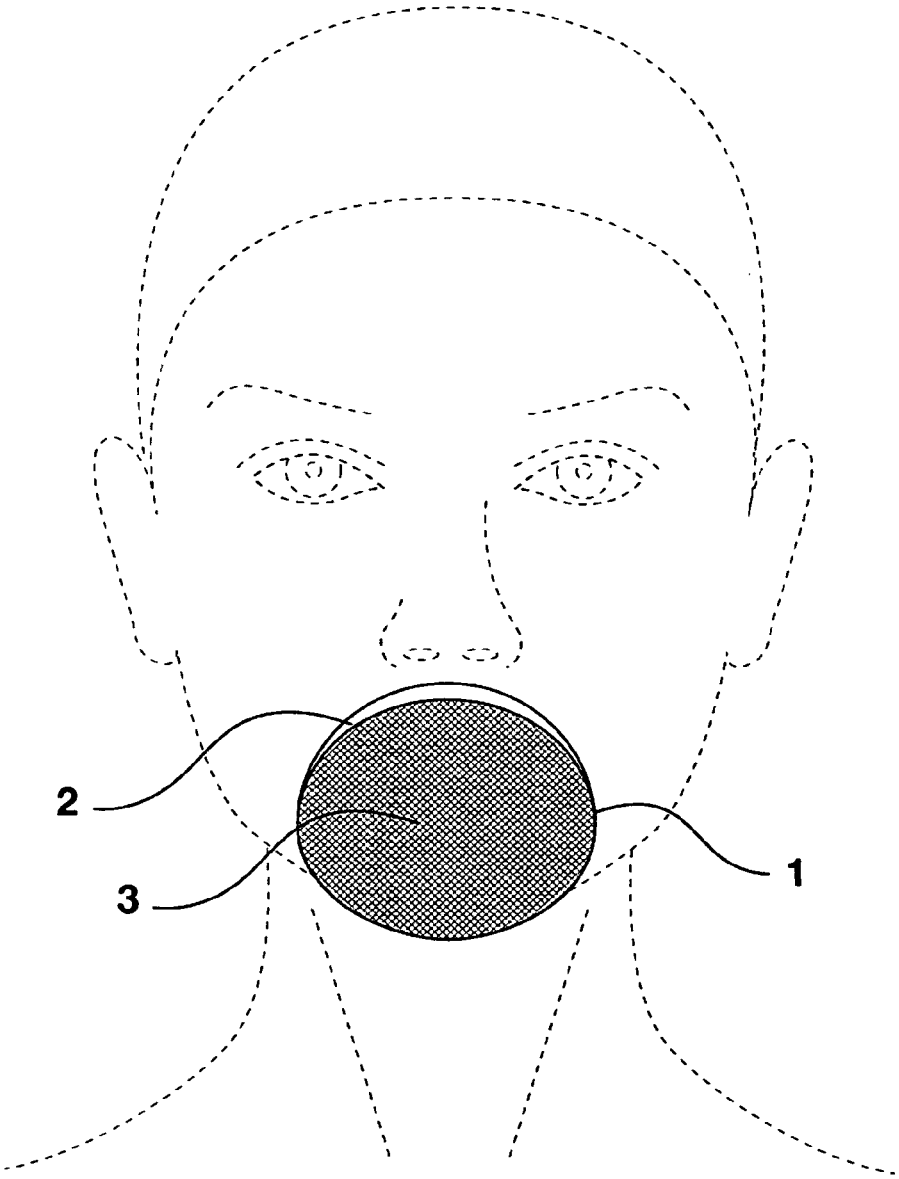
FIG. 1 is the front elevation view of the device as it fits onto the face of a person in broken lines.

FIG. 1 shows a front elevation view illustration of the device on the person's face with the main body of the device 1 the adhesive strip 2 that adheres to a person's face around the mouth area with the adhesive only being attached on the top half portion-of the main body of the device to allow a person to talk while wearing the device and not moving the device or to not allow the device to dis-adhere from the person's mouth area with the outside screen mesh layer 3.

Figure 2:
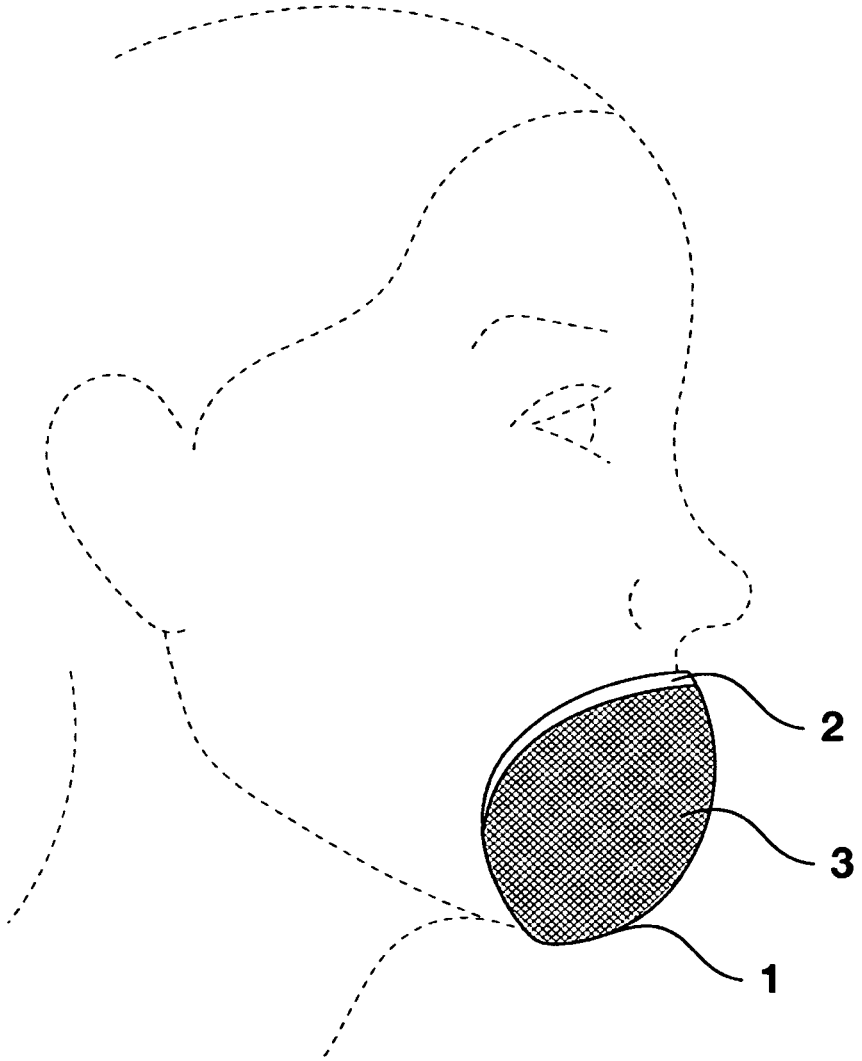
FIG. 2 is the side elevation view of the device as it fits onto the face of a person in broken lines.

FIG. 2 shows a side elevation view illustration of the device on the main body of the device 1 the adhesive strip 2 that adheres to a person's face around the mouth area with the adhesive only being attached on the top half portion of the main body of the device to allow a person to talk while wearing the device and not moving the device or to not allow the device to dis-adhere from the persons mouth area with the outside screen mesh layer 3.

Figure 3:
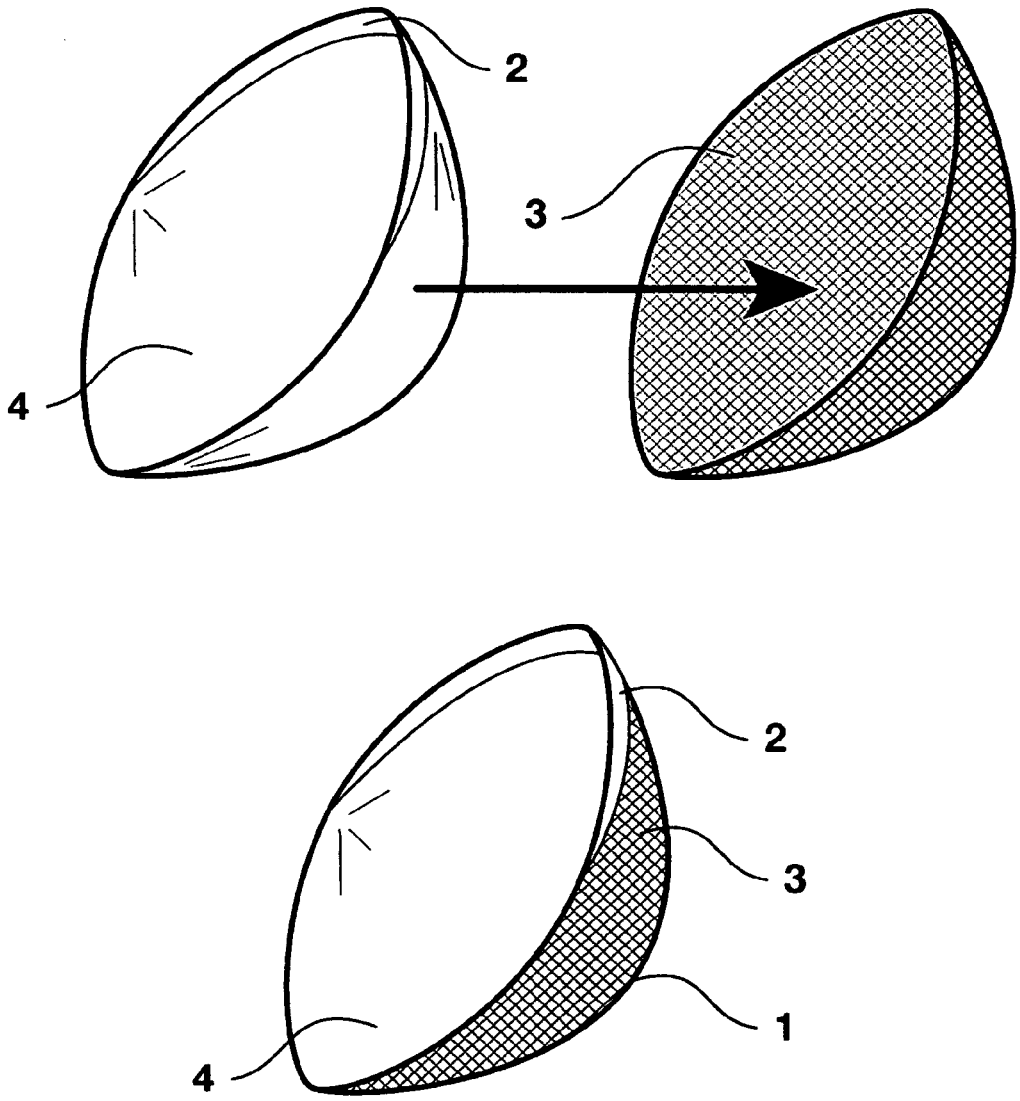
FIG. 3 is the exploded elevation view of the device in all of its parts.

FIG. 3 shows an exploded elevation view illustration showing all the parts of the device with the main body of the device 1 includes the adhesive strip 2 that adheres to a person's face around the mouth area with the adhesive only being attached on the top half portion of the main body of the device to allow a person to talk while wearing the device and not moving the device or to not allow the device to dis-adhere from the person's mouth area with the outside screen mesh layer 3 and the nylon screen layer 4 that attaches to the outside mesh layer to prevent the spittle from a person's mouth when they sneeze or cough or talk therefore preventing any bacteria from spewing into the air to not expose anyone close to any bacteria spread.

DETAILED DESCRIPTION OF THE INVENTION

The Mouth Mesh is a device as a mouth cover. The device is designed to fit around a person's mouth area just under the nose. The main body of the device is made of a plastic or wire frame that an outer screen mesh with a larger cell structure is attached to the frame. Attached to the back portion of the frame is an adhesive strip that is placed around the top half of the frame that adheres to the person's face around the mouth area. The bottom half of the frame has no adhesive so that a person may talk while they are wearing the device therefore the device will not fall off of the person's mouth area while they are talking. Inside of the outer mesh there is a nylon screen mesh as an inner liner similar to a type of pantyhose material that has a much smaller cell structure attached to the outer screen mesh so that any spittle coming from a person's mouth is caught in the inner liner. This prevents any spittle and therefore any bacteria from spraying or spreading into the air and possibly infect any other person in the immediate area.

What is claimed is:

1. A method of preventing spittle and bacteria from spreading into the air from a person's mouth, the method comprising:

providing a mouth mesh device, the mouth mesh device comprising:

a main body having a plastic or wire frame;

an outside screen mesh layer attached to the frame;

an inner nylon screen mesh layer attached to the outside screen mesh layer, the outside screen mesh layer having a larger cellular structure than the inner nylon screen mesh layer; and an adhesive strip attached to only a top half portion of the frame;

attaching the adhesive strip to the person's face above the person's mouth and below the person's nose; and wherein a bottom half of the frame is not adhered to the person's face so that the person may talk while wearing the device without the device falling off the person's face.

* * * * *